US010507642B2

(12) United States Patent
Lewinz et al.

(10) Patent No.: US 10,507,642 B2
(45) Date of Patent: Dec. 17, 2019

(54) ROLLER ARRANGEMENT, A METHOD OF FORMING A PATTERN, A METHOD OF PRINTING A PATTERN AND APPARATUS FOR PRINTING A PATTERN

(71) Applicant: HP INDIGO B.V., Amstelveen (NL)

(72) Inventors: Lior Lewinz, Ness Ziona (IL); Gil Fisher, Ness Ziona (IL); Stylianos Manousakis, Sant Cugat del Valles (ES)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/540,495

(22) PCT Filed: Jan. 23, 2015

(86) PCT No.: PCT/EP2015/051379

§ 371 (c)(1),
(2) Date: Jun. 28, 2017

(87) PCT Pub. No.: WO2016/116168

PCT Pub. Date: Jul. 28, 2016

(65) Prior Publication Data

US 2018/0001616 A1 Jan. 4, 2018

(51) Int. Cl.

| | |
|---|---|
| ***B41F 31/20*** | (2006.01) |
| ***B41F 31/02*** | (2006.01) |
| ***B41M 1/04*** | (2006.01) |

(52) U.S. Cl.

CPC ..... *B41F 31/20* (2013.01); *B41F 31/027* (2013.01); *B41M 1/04* (2013.01); *B41P 2231/20* (2013.01)

(58) Field of Classification Search

CPC ..... B41F 31/20; B41F 31/027; B41F 31/28; B41M 1/04; B41P 2227/00; B41P 2227/70; B41P 2231/20

See application file for complete search history.

(56) References Cited

U.S. PATENT DOCUMENTS 3,871,326 A * 3/1975 Kanda ..... G03C 1/74 118/63
4,157,903 A * 6/1979 Kanda ..... B01D 45/16 118/600
5,072,671 A * 12/1991 Schneider ..... B41C 1/1091 101/128.21

(Continued)

FOREIGN PATENT DOCUMENTS

DE 3608944 10/1986
JP 57140167 A * 8/1982 ..... B41F 31/007

(Continued)

OTHER PUBLICATIONS

Koenig & Bauer Group, "Process", Nov. 19, 2007, <http://www.kba.com/fileadmin/user_upload/KBA_Prozess/prozess_4_e.pdf> Issue Jan. 2007, 59 pages.

*Primary Examiner* — David H Banh
(74) *Attorney, Agent, or Firm* — Perry + Currier Inc

(57) ABSTRACT

A roller arrangement for printing apparatus comprises a first roller. The first roller comprises a plurality of cells. Each of the plurality of cells receives an amount of a coating material. The roller arrangement further comprises an extractor to remove at least a portion of the coating material from a selected set of the plurality of the cells.

15 Claims, 3 Drawing Sheets

(56) References Cited

U.S. PATENT DOCUMENTS

| | | | | |
|---|---|---|---|---|
| 5,154,121 | A * | 10/1992 | Schneider | B41M 1/10 101/128.21 |
| 6,419,987 | B1 * | 7/2002 | Bauer | B41M 5/52 427/301 |
| 6,536,876 | B1 * | 3/2003 | Fotland | B41J 2/01 347/55 |
| 6,772,686 | B2 | 8/2004 | Van Wert | |
| 6,862,031 | B1 * | 3/2005 | Moore | B41J 2/415 347/125 |
| 8,007,984 | B2 | 8/2011 | Teltschik et al. | |
| 2003/0167948 | A1 | 9/2003 | Weitz | |
| 2004/0046860 | A1 | 3/2004 | Beier et al. | |
| 2009/0145314 | A1 * | 6/2009 | Botrie | B41F 9/00 101/153 |
| 2012/0040283 | A1 * | 2/2012 | Heuft | G03G 5/0589 430/56 |
| 2012/0291642 | A1 | 11/2012 | Barton | |
| 2013/0108966 | A1 | 5/2013 | Arnold et al. | |
| 2013/0288024 | A1 | 10/2013 | Clauter et al. | |
| 2014/0144894 | A1 * | 5/2014 | Bergfeld | B23K 26/0676 219/121.69 |
| 2015/0375497 | A1 * | 12/2015 | Stowe | B41F 35/04 101/348 |

FOREIGN PATENT DOCUMENTS

| | | |
|---|---|---|
| JP | S57140167 | 8/1982 |
| WO | WO-2007091028 | 8/2007 |

* cited by examiner

ROLLER ARRANGEMENT, A METHOD OF FORMING A PATTERN, A METHOD OF PRINTING A PATTERN AND APPARATUS FOR PRINTING A PATTERN

CROSS-REFERENCE TO RELATED APPLICATION

This application is a U.S. National Stage Application of and claims priority to International Patent Application No. PCT/EP2015/051379, filed on Jan. 23, 2015, and entitled "A ROLLER ARRANGEMENT, A METHOD OF FORMING A PATTERN, A METHOD OF PRINTING A PATTERN AND APPARATUS FOR PRINTING A PATTERN."

BACKGROUND

A roller arrangement for a printing apparatus in which, for example, a pattern is formed on a roller to be transferred to a medium. The pattern may be formed by depositing an amount of coating material onto a preformed plate, for example a flexographic plate, which defines the pattern to be transferred to the medium in printing the pattern.

BRIEF DESCRIPTION OF DRAWINGS

For a more complete understanding, reference is now made to the following description taken in conjunction with the accompanying drawings in which.

DETAILED DESCRIPTION

An example of an existing roller arrangement that is used in flexography comprises at least one flexographic plate. The flexographic plate comprises a relief of a pattern of an image to be printed on medium. The flexographic plate is preformed and mounted on a plate cylinder (roller). A measured amount of coating material, for example, an ink or vanish is transferred onto the flexographic plate(s). The relief of the flexographic plate comes into contact with the medium and hence a pattern of the coating material, defined by the plate, is transferred (printed) onto the medium.

The measured amount of the coating material is transferred onto the flexographic plate(s) of the plate cylinder by an Anilox roller. The Anilox roller comprises a plurality of cells (or cavities) in the surface of the roller. A predetermined amount of the coating material is deposited into each of the cells and as the Anilox roller and the plate cylinder, which are in contact, rotate, the predetermined amount of coating material within the plurality of cells of the Anilox roller is transferred onto the flexographic plates of the plate cylinder.

However, in order to change the pattern to be printed, the flexographic plates are replaced which time is consuming with significant, associated cost implications. Therefore, flexography printing is widely used in printing high quality, highly repetitive patterns with a high level of consistency, for example, on folding cartons for the food industry.

With the new development in digital printing engines for the short run folding cartons market where the pattern to be printed (and hence the flexographic plates) is changed more frequently, there are still lots of finishing processes which generate a variety of plates and dies. These are then used to replace the current plates and/or rollers in the printing apparatus which significantly slows down the process and increases costs.

One digital solution for selective coating is the use of inkjet techniques. As the folding cartons need high coverage (protection layer) the cost per page in using inkjet techniques is expensive. Further, the coating quality is not always acceptable. Furthermore, the inkjet works with a specific set of varnishes using in coating the folding cartons. Therefore, if other varnishes which work well with the coaters are to be used, the new varnish may cause visual differences when using the inkjet techniques.

Figure 1:
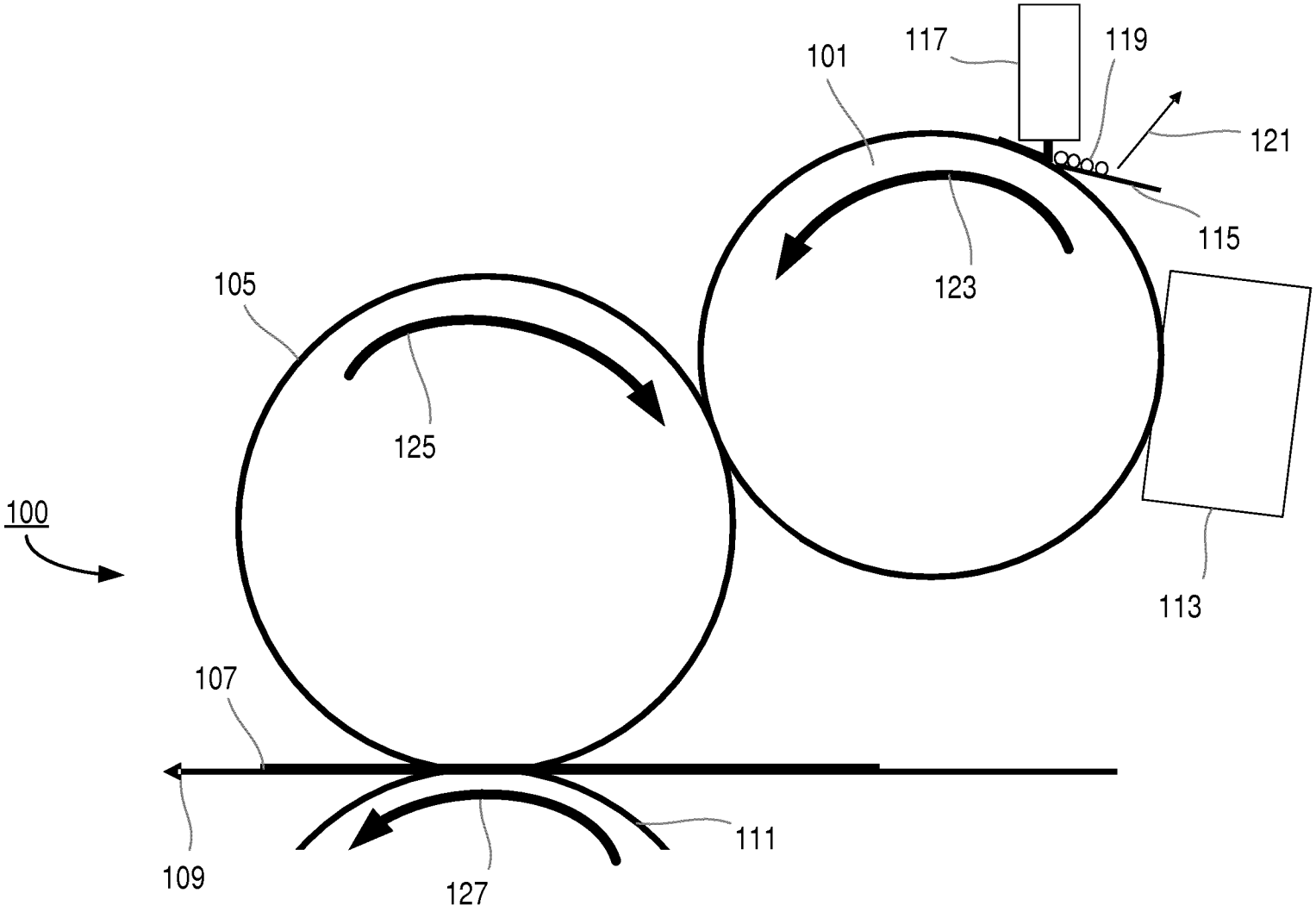
FIG. 1 is a simplified schematic of an example of apparatus for printing a pattern.

An example of apparatus for printing a pattern, as shown in FIG. 1, comprises a roller arrangement 100. The roller arrangement 100 comprises a first roller 101. The first roller 101 comprises a plurality of cells or cavities, each of the plurality of cells receiving an amount of a coating material. The coating material may be a printing fluid such as, for example, an ink or treatment fluid such as, for example, a gloss/matt coating, a barrier coating, ant-slip coating etc. The roller arrangement 100 further comprises an extractor 117 to remove at least a portion of the coating material from a selected set of the plurality of cells.

The printing apparatus further comprises a coating material deposition arrangement. The coating material deposition arrangement comprises a chamber 113 and a blade 115. The coating material deposition arrangement deposits, 401, an amount of coating material in each of the plurality of cells. The chamber 113 may comprise a closed chamber which deposits the coating material over the surface of the first roller 101 by virtue of rotation of the first roller 101, the coating material arrangement 113 may comprise a tray in which the first roller 101 rotates picking up the coating material over its surface as it rotates in the tray of coating material.

Figure 2:
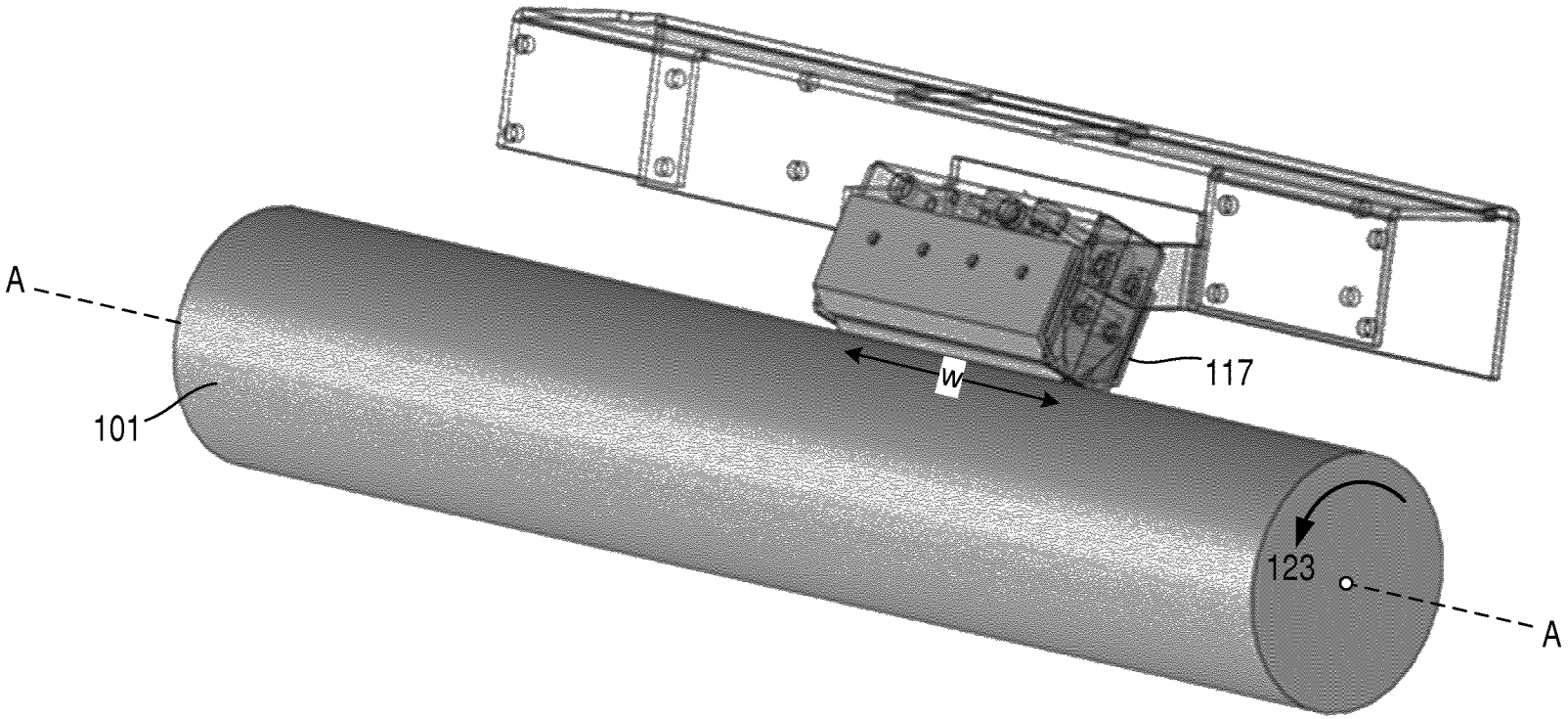
FIG. 2 is a simplified schematic of an example of part of the roller arrangement of the apparatus of FIG. 1.

The first roller 101 of the roller arrangement 100 is shown in more detail in FIG. 2. The first roller 101 is substantially cylindrical in shape and is rotatable about its longitudinal axis A-A. The surface of the first roller 101 comprises a plurality of cells or cavities 103 (shown in FIG. 3). The number of cells formed on the first roller 101 varies greatly depending on the amount of coating material to be transferred to the flexographic plates, the properties of the coating material, medium etc.

The coating material is deposited over the surface of the first roller 101 from the chamber 113 such that the coating material is deposited over the surface of the first roller 101. As the first roller rotates about its axis A-A in the direction of the arrow 123, it comes into contact with a blade 115, for example a doctor blade. The blade 115 is angled with reference to the surface of the first roller 101. The blade is angled such that it removes the excess coating material deposited, 401, by the chamber 113 whilst leaving an amount within each cell 103. The removed coating material 119 may be directed away from the surface of the first roller 101 along the surface of the blade 115 in the direction of the arrow 121.

The extractor 117 of the roller arrangement 100 is located in the vicinity of the location of the blade 115, downstream of the blade 115. The extractor 117 is mounted as shown in FIG. 2, in a radially outwardly extending location within an upper region of the roller 101. The width of the extractor 117 extends across the width w of the print area so that as the first roller rotates in the direction of the arrow 123 about its axis A-A, the extractor 117 covers substantially all of the print area.

The extractor 117 is located close to the surface of the first roller 101 and removes, 403, at least a portion of coating material 119 from a selected set of the plurality of cells of the first roller 101 as the first roller 101 rotates in the direction of the arrow 123 about its axis A-A. The removal of at least a portion of the coating material from a selected set of the plurality of the cells forms a pattern of coating material in the remaining cells. In one example, the extractor removes an amount in region of 50-70% of the amount deposited in the selected cell.

The roller arrangement 100 further comprises a second roller 105 having a substantially flexible, substantially smooth, rubber-like surface in contact with the surface of the first roller 101. The second roller 105 is substantially cylindrical in shape and is rotatable about its longitudinal axis. The axis of rotation A-A of the first roller 101 is substantially parallel to the axis of rotation of the second roller 105 so that the whole surface of the first roller comes into contact with, at least a portion, of the surface of the second roller 105 as the first and second rollers rotate, depending on the relative diameters of the first and second roller 101, 105. For example, the diameter of the first roller 101 may be less than the diameter of the second roller 105 such that the pattern formed by the remaining coating material in the cells 103 of the first roller 101 is rotated more than once to contact the surface of one rotation of the second roller 105.

As the first roller 101 rotates about its axis A-A in the direction of the arrow 123 and the second roller 105 rotates about it axis in the direction of the arrow 125, the first roller 101 is in contact with the second roller such that the surface of the second roller 105 is compressed slightly. The pattern of coating material formed on the surface of the first roller 101 is transferred to the surface of the second roller 105. The second roller 105 is in contact with medium 107 which is fed in the direction of the arrow 109 by at least one third roller 111. As the second roller 105 rotates, it comes into contact with the medium 107, the pattern of the coating material transferred from the first roller 101 is printed onto a portion of the surface of the medium 107. The medium may be in the form of any variety of paper (lightweight, heavyweight, coated, uncoated, paperboard, cardboard, etc.), films, foils, textiles, fabrics, or plastics or the like.

Figure 3:
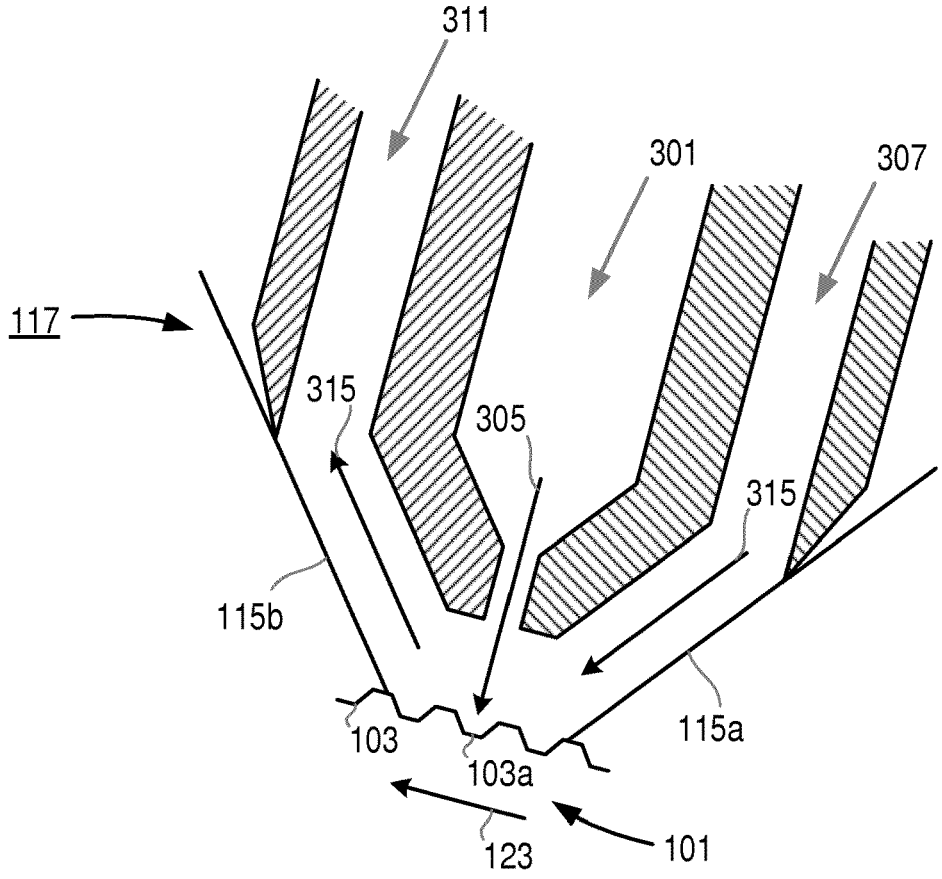
FIG. 3 is a simplified schematic of an example of a cross-section of the extractor and a part of the roller arrangement of the apparatus of FIGS. 1 and 2.
Figure 4:
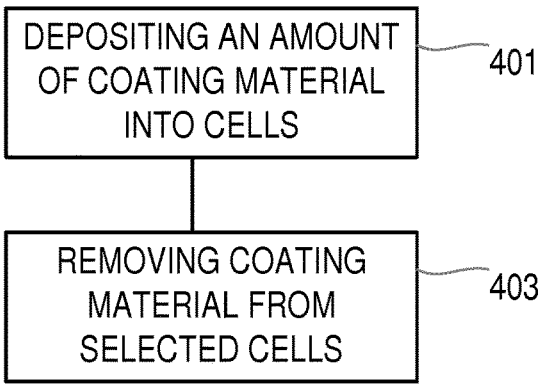
FIG. 4 is a flowchart of an example of a method for forming a pattern.

An example of a cross-section of the extractor 117 is shown in FIG. 3. The extractor 117 comprises a plurality of port arrangements arranged in parallel across the width w of the print area and hence the width of the extractor 117. The number of port arrangements depends on the resolution of the printed image, properties of the coating material and medium etc.

The cross-section shown in FIG. 3 is taken through one of the plurality of port arrangements. Each port arrangement comprises a first air port 301, having an outlet located in substantially close vicinity with the surface of the first roller 101 to direct a high velocity jet of air, generated by pressurising an air flow, in a radial direction (illustrated by the arrow 305 in FIG. 3) into a selected cell 103*a* of a plurality of cells 103 of the surface of the first roller 101 to extract the coating material from the selected cell 103*a*. The first air port 301 is connected to a first control unit (not shown in the Figures). The first control unit controls the velocity of the jet of air and the distance of the first air port 301 outlet based on the properties of the coating material, for example, the viscosity of the coating material.

Each port arrangement of the extractor 117 further comprises a second air port 307 located upstream of the first air port 301 and located at a second distance from the surface of the first roller 101. The second air port 307 is connected to a second control unit (not shown in the Figures) and is positioned to create an air flow onto the surface of the first roller 101 upstream of the selected cell 103*a* substantially parallel to the surface of the first roller 101 across the selected cell 103*a* to a location downstream of the selected cell 103*a* (indicated by the series of arrows 315 in FIG. 3). The velocity of the jet of air from the first air port 301 is substantially greater than the velocity of the air flow of the second air port 307. Each port arrangement of the extractor 117 further comprises an evacuation port 311. The evacuation port 311 is located downstream of the first air port 301. The evacuation port 311 is connected to a third control unit (not shown in the Figures). The air flow generated by the second air port 307 and its control unit flows along the surface of the first roller into the evacuation port 311. The third control unit may be activated to create a vacuum to draw the air flow into the evacuation port 311 from the surface of the first roller 101. The first, second and third control units may be connected to a central controller (not shown in the Figures).

The extractor 117 may be located downstream of the blade 115. In an alternative arrangement, the evacuator is located between a first and second blade 115*a*, 115*b* as shown in FIG. 3. Each of the first and second blades 115*a*, 115*b* contact the surface of the first roller and extend across the width w of the print area, the width of the extractor 117 either side of the plurality of port arrangements. The first and second blades 115*a*, 115*b* remove excess coating material deposited by the coating material deposition arrangement 113 to leave a predetermined amount of coating material in each of the plurality of cells 103. The air flow from the second air port 307 to the evacuation port 311 is directed to flow along the surfaces of a first blade 115*a* and a second blade 115*b*. The first blade 115*a* is located upstream of the second air port 307 and the second blade 115*b* is location downstream of the evacuation port 311.

The central controller receives instructions defining a predetermined pattern to be printed on the medium. The predetermined pattern defines the location of each of the selected cells 103*a*. The central controller generates control signals to each of the first, second and third control units to activate or to deactivate the first, second air ports 301, 307 and/or the evacuation port 311 in accordance to whether a selected cell 103*a* is currently located in close vicinity to the first air port 301. As a result, the coating material within the selected cell 103*a* is extracted by the high velocity jet of air 305 from the first air port 301. The extracted coating material is then evacuated from the surface of the roller 101 by the air flow 315 of the second air port 307 along the surface of the second blade 115*b* into the evacuation port 311.

In the roller arrangement described above material is removed according to a predetermined pattern by the use of the high velocity jet of air that clears the cells in the roller, such as the Anilox roller, and directs the coating material for further removal. Therefore, the roller arrangement described above provides endless variations in the printing pattern without the having to use or replace flexographic plates.

As a result, the roller arrangement described above allows the pattern to be easily changed by merely controlling the first air port 301 and the second air port 307 and/or the evacuation port 311 via their respective control units to remove at least a portion of coating material from a selected set of cells which is more cost effective and easier than having to use and replace the flexographic plates. Therefore, in a printing process in which each page is different, there is no substantial setup time or plate making. Further in comparison with digital inkjet printing apparatus, the cost per page is less whilst maintaining quality of the printed coating material. Further the apparatus described above enables coating materials to be used.

It should be noted that the above-mentioned examples illustrate rather than limit what is described herein, and that those skilled in the art will be able to design many alternative implementations without departing from the scope of the appended claims. The word "comprising" does not exclude the presence of elements other than those listed in a claim, "a" or "an" does not exclude a plurality, and a single processor or other unit may fulfil the functions of several units recited in the claims.

The invention claimed is:

1. A roller arrangement for printing apparatus, the roller arrangement comprising:

a first roller, the first roller comprising a plurality of cavities, each of the plurality of cavities to receive an amount of a coating material; and an extractor to remove at least a portion of the coating material from a selected set of the plurality of cavities.

2. The roller arrangement of claim 1, wherein the extractor comprises a first air port to direct a jet of air onto each of the selected set of the plurality of cavities to extract at least a portion of the coating material therefrom.

3. The roller arrangement of claim 2, wherein the extractor comprises a second air port to direct an air flow substantially parallel to a surface of the first roller to evacuate the coating material removed from the selected set of the plurality of cavities of the first roller.

4. The roller arrangement of claim 3, wherein the velocity of the jet of air from the first air port is substantially greater than the velocity of the air flow of the second air port.

5. The roller arrangement of claim 3, wherein the roller arrangement further comprises at least one blade to remove excess coating material from the surface of the first roller such that a predetermined amount of coating material remains in each of the plurality of cavities.

6. The roller arrangement of claim 5, wherein the at least one blade is further to direct the air flow of the second air port towards and/or away from the surface of the first roller and/or to direct the coating material extracted from the selected set of the plurality of cavities by the jet of air of the first air port away from the surface of the first roller.

7. The roller arrangement of claim 3, wherein the extractor further comprises an evacuation port to generate a vacuum to evacuate the removed coating material, within the air flow of the second air port, away from the surface of the first roller.

8. The roller arrangement of claim 7, wherein the extractor further comprises a control system to switch activation of the first air port, the second air port and/or the evacuation port to remove at least a portion of the coating material from the selected set of the plurality of cavities.

9. A roller arrangement of claim 1, wherein the roller arrangement comprises a second roller in contact with the first roller to receive a pattern of the coating material from the first roller, the pattern being formed by the removal of the coating material from the selected set of the plurality of cavities.

10. A method for forming a pattern of a coating material on a first roller for transfer to a second roller, the first roller comprising a plurality of cavities, the method comprising:

depositing an amount of a coating material in each of the plurality of the cavities of the first roller; and removing at least a portion of deposited coating material from a selected set of plurality of cavities of the first roller to form a pattern of the coating material on the surface of the first roller.

11. The method of claim 10, wherein removing at least a portion of deposited coating material further comprises:

directing a jet of air onto each cavity of the selected set of the plurality of cavities to extract at least a portion of the deposited coating material from the selected cavity.

12. The method of claim 11, wherein removing at least a portion of deposited coating material further comprises:

creating an air flow substantially parallel to the surface of the first roller to evacuate the coating material extracted from the selected set of plurality of cavities of the first roller.

13. The method of claim 12, removing at least a portion of deposited coating material further comprises:

controlling the jet of air and/or the air flow to remove at least portion of the deposited coating material from the selected set of the plurality of cavities of the first roller to form the pattern.

14. A method for printing a pattern onto a medium, the method comprising depositing a coating material over the surface of a first roller, the first roller comprising a plurality of cavities and an amount of the coating material is deposited into each of the plurality of cavities;

removing at least a portion of deposited coating material from a selected set of the plurality of cavities of the first roller to form a pattern of the coating material on a surface of the first roller; and transferring the formed pattern from the surface of the first roller onto a surface of a second roller, the second roller being in contact with at least a portion of the medium to print the pattern transferred onto the surface of the second roller onto at least a portion of the medium.

15. Apparatus for printing a pattern onto a medium, the apparatus comprising a first roller comprising a plurality of cavities;

a second roller in contact with the first roller and the medium;

a coating material deposition arrangement to deposit an amount of coating material in each of the plurality of cavities; and an extractor to remove at least a portion of deposited coating material from a selected set of the plurality of cavities to form a pattern on the surface of the first roller for transfer to the surface of the second roller and to transfer from the surface of the second roller to at least a portion of the medium.

* * * * *